US011111680B2

(12) United States Patent
Ha

(10) Patent No.: US 11,111,680 B2
(45) Date of Patent: Sep. 7, 2021

(54) EXHAUST GAS DISCHARGE DEVICE FOR FIRE ENGINE IN FIRE STATION

(71) Applicant: CHEONG GU INNOVATION CO., LTD., Ulsan (KR)

(72) Inventor: Sang Soon Ha, Ulsan (KR)

(73) Assignee: CHEONG GU INNOVATION CO., LTD., Ulsan (KR)

( * ) Notice: Subject to any disclaimer, the term of this patent is extended or adjusted under 35 U.S.C. 154(b) by 338 days.

(21) Appl. No.: 16/340,110

(22) PCT Filed: Jul. 31, 2017

(86) PCT No.: PCT/KR2017/008249
§ 371 (c)(1),
(2) Date: Apr. 6, 2019

(87) PCT Pub. No.: WO2018/066798
PCT Pub. Date: Apr. 12, 2018

(65) Prior Publication Data

US 2020/0011072 A1 Jan. 9, 2020

(30) Foreign Application Priority Data

Oct. 7, 2016 (KR) ..... 10-2016-0129714

(51) Int. Cl.
*E04F 17/02* (2006.01)
*F24F 11/30* (2018.01)

(52) U.S. Cl.
CPC ..... *E04F 17/02* (2013.01); *F24F 11/30* (2018.01)

(58) Field of Classification Search
CPC ... F24F 11/00; F24F 7/06; F24F 11/30; B08B 15/00; B08B 15/002; B08B 15/005; B08B 15/007; E04F 17/02
See application file for complete search history.

(56) References Cited

U.S. PATENT DOCUMENTS 4,216,710 A * 8/1980 Asmus ..... B08B 15/002 104/52
5,092,228 A * 3/1992 Pfeiffer, Jr. ..... B08B 15/00 104/52

(Continued)

FOREIGN PATENT DOCUMENTS

JP 2000-074430 A 3/2000
JP 2009-167667 A 7/2009

(Continued)

*Primary Examiner* — Steven S Anderson, II
(74) *Attorney, Agent, or Firm* — Maschoff Brennan

(57) ABSTRACT

The present invention provides an exhaust gas discharge device for a fire engine in a fire station, the device comprising: a base frame inserted into a guide groove formed on the floor of the garage of the fire station; a lifting frame connected to the upper part of the base frame to slide in a vertical direction; a suction hood having a suction hole on one side while having a container shape including a space unit inside thereof; a discharge pipe unit for guiding the exhaust gas of the fire engine in the garage to be discharged to the outside of the garage; a discharge fan for generating a suction force for the exhaust gas to be discharged to the outside of the garage through the discharge pipe unit; a lifting means for generating a driving force to slide the lifting frame in the vertical direction; a rotation connection member for enabling the suction hole of the suction hood to face an exhaust port of the fire engine while the suction hood rotates around the hinge when the lifting frame ascends by the lifting means; a stopper for stopping a wheel of the fire engine when the fire engine stops while the exhaust port of the fire engine is adjacent to the front side of the upper part of the suction hood; a stop sensor for detecting whether the stopper of the fire engine is stopped; a vehicle sensor detecting whether the fire engine enters the direction of the stopper unit; and a control unit for controlling the operation of the lifting means and the discharge fan in accordance with (Continued)

a signal of the vehicle sensor and the stop sensor or controlling the operation of the lifting means and the discharge fan by a user regardless of the signal of the stop sensor and the vehicle sensor.

6 Claims, 4 Drawing Sheets

(56) References Cited

U.S. PATENT DOCUMENTS 5,542,250 A * 8/1996 Ball ..... B08B 15/002 454/63
5,630,751 A * 5/1997 Hansen ..... B08B 15/005 454/64
6,306,031 B1 * 10/2001 Hansen ..... B08B 15/002 454/63

FOREIGN PATENT DOCUMENTS

| | | | |
|---|---|---|---|
| KR | 10-0560219 | B1 | 3/2006 |
| KR | 2006-0028379 | A | 3/2006 |
| KR | 10-1054805 | B1 | 8/2011 |
| KR | 10-1575122 | B1 | 12/2015 |

* cited by examiner

[Fig. 1]
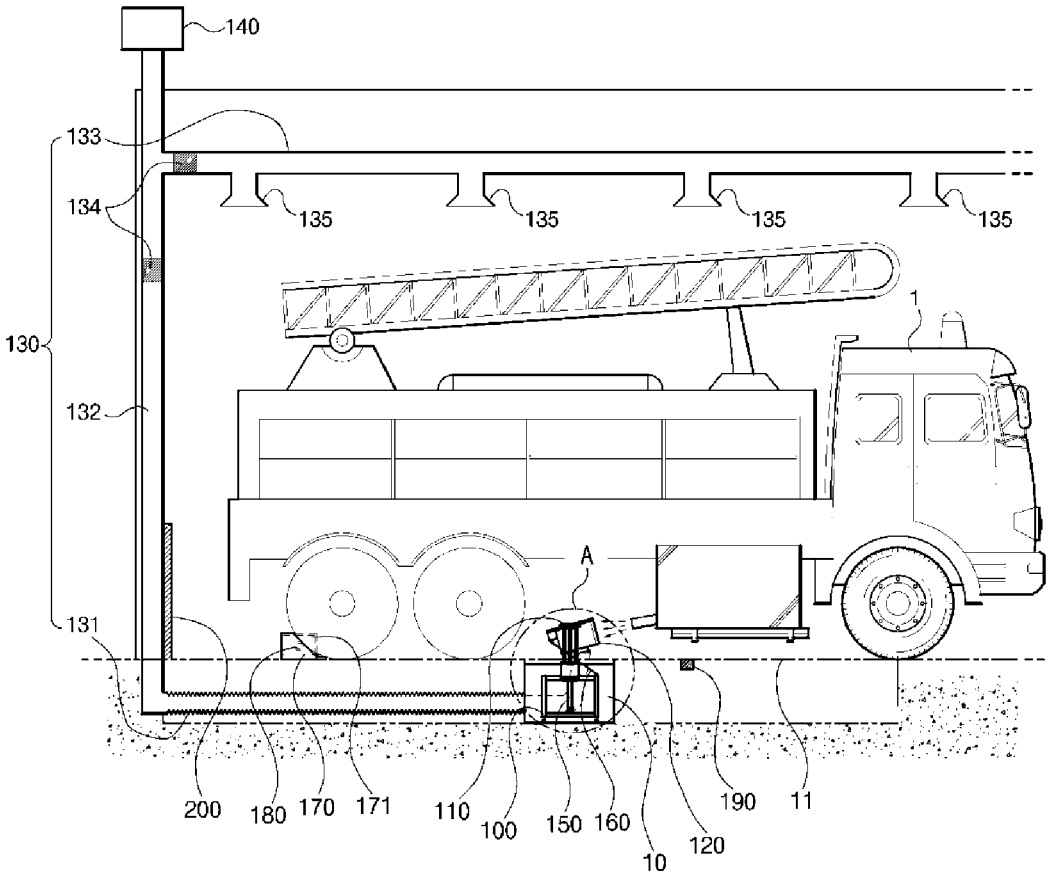

[Fig. 2]
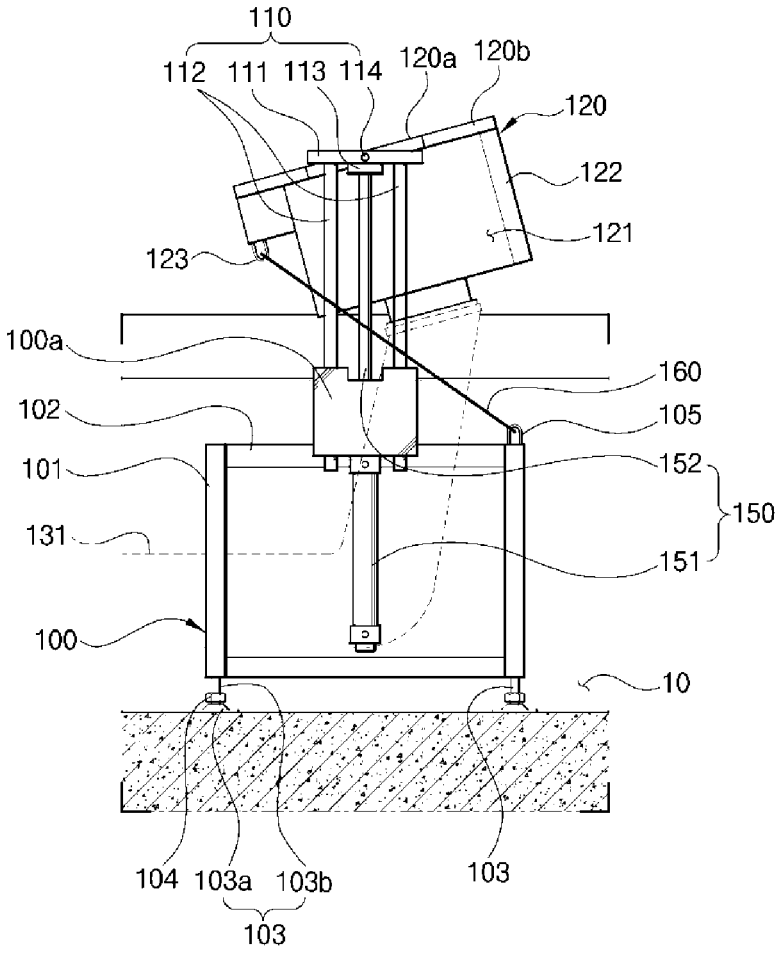

[Fig. 3]
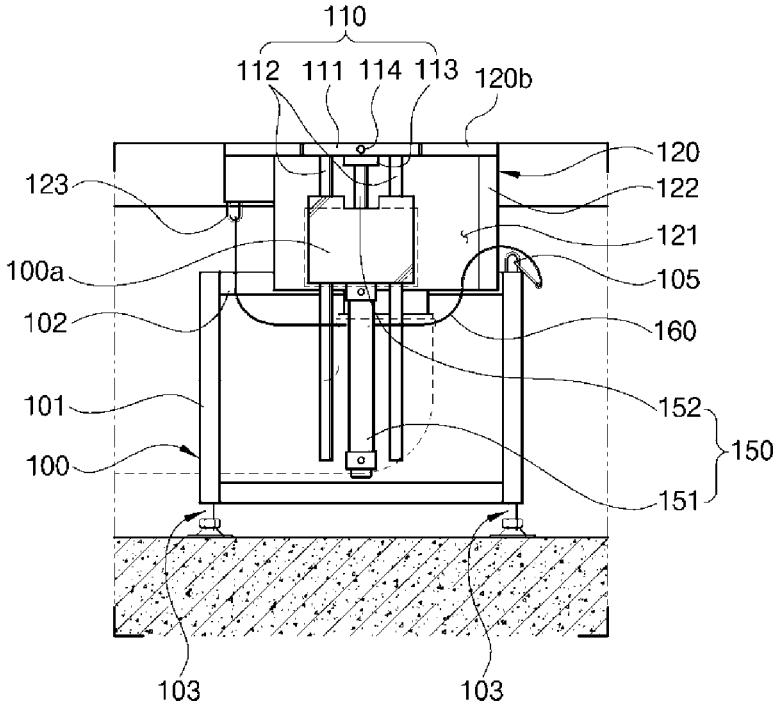

[Fig. 4]
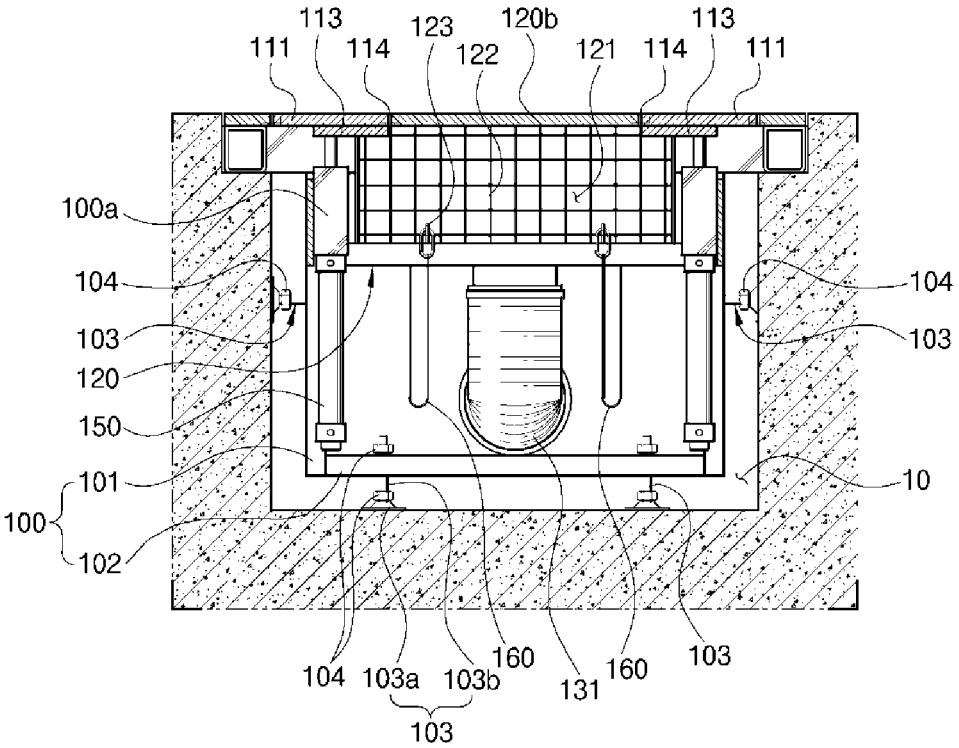

EXHAUST GAS DISCHARGE DEVICE FOR FIRE ENGINE IN FIRE STATION

TECHNICAL FIELD

The present invention relates to a fire-engine exhaust-gas discharge device in a fire station, which causes suction and discharge of exhaust gas generated during driving of a firefighting vehicle in a garage of the fire station.

BACKGROUND ART

Generally, all vehicles possessed by a fire station located in a big city are diesel vehicles. In the case in which such a vehicle is driven in a garage at the time of initial start-up or when returned to the fire station after firefighting activities, gas discharged from an engine causes firemen to be directly exposed to dangerous substances and does harm to the health of the firemen.

In addition, considering the characteristics of driving of the diesel vehicle in the fire station, the firemen mainly suffer from exhaust gas due to emergency inspection (of firefighting vehicles and various communication equipment, etc.) in the morning, and particularly, at the time of start-up in the cold state of the engine in the morning, white smoke is initially generated due to the characteristics of combustion, and then blue smoke is generated after a short time. The main gaseous component of the blue smoke is aldehyde which stings the eyes and causes nausea, and thus is dangerous to the human body. Moreover, nitrogen oxide (NOx) and graphite (black smoke) are generated upon complete combustion and cause generation of fine dust while changing into a material that worsens air pollution as well as deterioration in the health of the human body.

As already seen above, the exhaust gas of the firefighting vehicle using diesel contains a lot of harmful factors to the human body, and when such a residual gas circulates in the garage, fireman who spend most of their time in an indoor space may breathe in the gas, and this may threaten the health of the firemen.

Therefore, although it is conceivable to open a shutter or a window of the garage or to operate a ventilator, for example, in order to discharge the residual gas inside the garage of the fire station to the outside, these methods show low discharge efficiency of the residual gas. For this reason, conventionally, an exhaust-gas discharge device has been additionally provided to stably discharge the residual gas inside the garage of the fire station to the outside.

However, in such a conventional exhaust-gas discharge device, due to the fact that both a pipe unit and a suction unit are disposed so as to protrude into the space in the garage of the fire station, movement of the firefighting vehicle and the firemen in the garage may be hindered.

The exhaust-gas discharge device of the earlier application described above is disclosed in Korean Patent Laid-Open Publication No. 2006-0028379 (Mar. 29, 2006).

DISCLOSURE

Technical Problem

It is an object of the present invention to provide a fire-engine exhaust-gas discharge device, which is provided in a garage of a fire station so as not to interfere with the movement path of a firefighting vehicle and firemen and enables stabilized implementation of an exhaust-gas discharge operation.

Technical Solution

In accordance with an aspect of the present invention, provided is a fire-engine exhaust-gas discharge device in a fire station including a base frame inserted into a guide groove formed in a floor of a garage of the fire station, an elevating frame connected to an upper portion of the base frame so as to be slidable in a vertical direction, a suction hood rotatably connected to an upper end of the elevating frame by a hinge and having a cylindrical shape to define a space therein, the suction hood being formed with a suction hole in one side thereof, a discharge pipe unit having one longitudinal end coupled to the suction hood to communicate with the suction hood and a remaining longitudinal end disposed outside the garage, the discharge pipe unit being configured to guide exhaust gas of the firefighting vehicle in the garage so as to be discharged to an outside of the garage, a discharge fan connected to the discharge pipe unit to generate suction force that causes the exhaust gas to be discharged to the outside of the garage through the discharge pipe unit, an elevating drive device provided on the base frame and connected to the elevating frame to generate drive force that slides the elevating frame in the vertical direction, a rotational connection member having one longitudinal end connected to the base frame and a remaining longitudinal end connected to a remaining side of the suction hood, the rotational connection member being configured to cause the suction hood to rotate about the hinge when the elevating frame is moved upward by the elevating drive device so that the suction hole in the suction hood faces an exhaust port of the firefighting vehicle, a vehicle stopper coupled to the floor of the garage and configured to cause a wheel of the firefighting vehicle to be caught by the vehicle stopper in a state in which the firefighting vehicle is stopped such that the exhaust port thereof is disposed adjacent to an upper front side of the suction hood, a stoppage detection sensor provided on the vehicle stopper to detect whether or not the firefighting vehicle is stopped by the vehicle stopper, a vehicle detection sensor inserted into the guide groove to detect whether or not the firefighting vehicle enters a direction in which the vehicle stopper is provided, and a control unit electrically connected to the discharge fan, the elevating drive device, the stoppage detection sensor, and the vehicle detection sensor and configured to control an operation of the discharge fan and the elevating drive device in response to a signal from the stoppage detection sensor and the vehicle detection sensor or to allow a user to control the operation of the discharge fan and the elevating drive device regardless of the signal from the stoppage detection sensor and the vehicle detection sensor.

Advantageous Effects

In a fire-engine exhaust-gas discharge device in a fire station according to the present invention, when an elevating frame is moved upward by an elevating drive device in the state in which a base frame is provided in a guide groove formed in the floor of a garage of the fire station and a suction hood is rotatably connected to the elevating frame by a hinge, one side of the suction hod rotates so as to be adjacent to an exhaust port of a firefighting vehicle since the side of the suction hood is connected to the base frame via a rotational connection member, whereby the fire-engine exhaust-gas discharge device enables exhaust gas discharged from the exhaust port of the firefighting vehicle to be discharged stably to the outside of the garage and does not interfere with the movement or operation of firemen in the garage of the fire station at normal times.

DESCRIPTION OF DRAWINGS

FIG. 1 is a view illustrating the schematic overall configuration of a fire-engine exhaust-gas discharge device in a fire station according to an embodiment of the present invention;

FIG. 2 is an enlarged view of portion "A" illustrated in FIG. 1;

FIG. 3 is a view illustrating the state in which a suction hood illustrated in FIG. 2 is inserted into a guide groove; and FIG. 4 is a front view of FIG. 3.

BEST MODE

FIG. 1 is a view illustrating the schematic overall configuration of a fire-engine exhaust-gas discharge device in a fire station according to an embodiment of the present invention, FIG. 2 is an enlarged view of portion "A" illustrated in FIG. 1, FIG. 3 is a view illustrating the state in which a suction hood illustrated in FIG. 2 is inserted into a guide groove, and FIG. 4 is a front view of FIG. 3. Referring to FIGS. 1 to 4, the fire-engine exhaust-gas discharge device in the fire station according to the embodiment includes a base frame 100, an elevating frame 110, a suction hood 120, a discharge pipe unit 130, a discharge fan 140, an elevating drive device 150, a rotational connection member 160, a vehicle stopper 170, a stoppage detection sensor 180, a vehicle detection sensor 190, and a control unit 200.

The base frame 100 is a structure that is fixedly inserted into a guide groove 10 formed in the floor of a garage of the fire station. Here, the base frame 100 is illustrated as having a rectangular frame structure in which a plurality of vertical unit members 101 and a plurality of horizontal unit members 102 are connected to each other, but, needless to say, is not limited to this shape. Here, the guide groove 10 may be provided at the upper end thereof with a cover plate 11 to prevent a user or a wheel of a firefighting vehicle 1 from falling in the guide groove. In this case, the cover plate 11 is illustrated as being formed using a grating that is a cover having a net structure, but, needless to say, is not limited thereto, and a flat panel structure having no through-hole may also be applied to the cover plate.

Elevating guides 100*a* are coupled to the base frame 100 to guide the elevating frame 110, which will be described later, so as to be slidable in the vertical direction. The elevating guides 100*a* are vertically disposed on both sides of the upper end of the base frame 100 to guide the elevating frame 110 so as to be slidable in the vertical direction.

In addition, a plurality of fixing bolts 103 may be coupled to the base frame 100 to fixedly couple the base frame to the guide groove 10 in the state in which the fixing bolts are inserted into the guide groove. That is, the fixing bolts 103 are inserted into the guide groove 10 and are screwed to the base frame 100, which faces the floor of the garage. That is, a shaft portion 103*a* of each fixing bolt 103 penetrates the base frame 100 so as to be screwed to the base frame 100, and a head portion 103*b* of the fixing bolt 103 is disposed in close contact with the floor of the garage. Thus, in the state in which the base frame 100 is inserted into the guide groove 100, the position at which the fixing bolt 103 is fastened to the base frame 100 is adjusted so that the head portion of the fixing bolt 103 is fixed to transfer pressure to the floor of the garage. A fixing nut 104 may be fastened to the shaft portion 103*a* of the fixing bolt 103 so as to be brought into close contact with the base frame 100 and fix the fixing bolt 103 at the position at which the fixing bolt is screwed to the base frame 100. In addition, a contact plate (not illustrated) formed of rubber or a synthetic resin having flexibility may be coupled to the head portion of the fixing bolt 103 to increase frictional force and absorb vibration in the state in which the contact plate is in close contact with the floor of the garage.

In addition, a fixing loop 105 may be formed on the front side of the upper end of the base frame 100 so that one longitudinal end of the rotational connection member 160, which will be described later, may be connected to and caught by the fixing loop.

The elevating frame 110 is a structure that is connected to and supports the suction hood 120, which will be described later, so that the suction hood is movable up and down in the vertical direction. That is, the elevating frame 110 is provided on the base frame 100 so as to be slidable in the vertical direction, and the suction hood 120 is rotatably connected to the elevating frame 110. The elevating frame 110 includes a pair of elevating plates 111 connected to the respective elevating guides 100*a* on the base frame 100 so as to be slidable in the vertical direction and a pair of brackets 113 coupled respectively to one side of the bottom surfaces of the pair of elevating plates 111. Here, each of the pair of elevating plates 111 is coupled to elevating bars 112, which vertically extend downward from the elevating plate and are connected to a corresponding one of the elevating guides 100*a* in a sliding manner. In addition, a hinge 114 is coupled to each bracket 113 so that the suction hood 120 is rotatably connected to the bracket 113.

The suction hood 120 is a structure that stores exhaust gas discharged from an exhaust port of the firefighting vehicle 1 in the garage so that the exhaust gas is conveyed to the discharge pipe unit 130, which will be described later. The suction hood 120 is formed in a cylindrical shape to define a space in which the exhaust gas may be stored.

The suction hood 120 is rotatably connected to the elevating frame 110. More specifically, opposite sides of the suction hood 120 are rotatably connected to the respective brackets 113 of the elevating frame 110 via the hinges 114. Here, the suction hood 120 may be provided at the upper end thereof with a connection plate 120*b* formed with fastening holes 120*a* so that the brackets 113 of the elevating frame 110 are connected to the suction hood 120 via the hinges 114.

In addition, a suction hole 121 is formed in one side of the suction hood 120, more specifically, in the surface of the suction hood that faces the exhaust port of the firefighting vehicle 1 for communication between the inside and the outside of the suction hood 120 so that the exhaust gas discharged from the exhaust port may be introduced into the space inside the suction hood 120 through the suction hole. Here, a filter plate 122 may be coupled to one side of the suction hood 120 to prevent foreign substances, such as various kinds of waste, other than exhaust gas, from being introduced through the suction hole 121. The filter plate 122 may be formed using a grating having a net structure, but, needless to say, is not limited thereto, and may be formed using a filter member that prevents foreign substances having a predetermined size or larger from being introduced into the suction hood 120.

In addition, a connection loop 123 may be formed on the other side of the suction hood 120 so that the other longitudinal end of the rotational connection member 160, which will be described later, may be fixedly coupled to and caught by the connection loop.

The discharge pipe unit 130 is a pipeline that guides the exhaust gas, introduced into and stored in the suction hood 120, so as to be discharged to the outside of the suction hood 120, more specifically, to the outside of the garage, or that guides the exhaust gas floating inside the garage so as to be discharged to the outside of the garage. One longitudinal end of the discharge pipe unit 130 is coupled to one side of the suction hood 120, more specifically, to one side of the bottom surface of the suction hood 120 so as to be connected to the space defined inside the suction hood 120. In addition, the other longitudinal end of the discharge pipe unit 130 extends to the outside of the garage through the guide groove 10 in the floor of the garage. Here, the discharge pipe unit 130 includes a connection pipe 131, a discharge pipe 132, an indoor connection pipe 133, and dampers 134.

The connection pipe 131 is a pipe member that guides the exhaust gas, introduced into and stored in the suction hood 120 through the suction hole 121, so as to be conveyed to the discharge pipe 132. One longitudinal end of the connection pipe 131 is coupled to one side of the bottom surface of the suction hood 120 so as to communicate with the space inside the suction hood 120. In addition, the other longitudinal end of the connection pipe 131 is connected to one longitudinal end of the discharge pipe 132. Here, the connection pipe 131 is connected to the suction hood 120 and to the discharge pipe 132 in the state in which the connection pipe is inserted into the guide groove 10. In this case, the connection pipe has an elastic and flexible structure to realize stabilized discharge of the exhaust gas and enable vertical movement of the elevating frame 110 when the elevating frame 110 moves in the vertical direction on the base frame 100.

The discharge pipe 132 is a pipe member that guides the exhaust gas introduced into the connection pipe 131 from the suction hood 120 so as to be discharged to the outside of the garage. One longitudinal end of the discharge pipe 132 is connected to the other longitudinal end of the connection pipe 131, and the other longitudinal end of the discharge pipe 132 extends so as to be disposed outside the garage. Here, needless to say, a dust collecting device (not illustrated) may be connected to one side of the other longitudinal end of the discharge pipe 132 to filter out harmful components in the exhaust gas.

The indoor connection pipe 133 is a pipe member that guides the exhaust gas floating inside the garage so as to be discharged through the discharge pipe 132. One longitudinal end of the indoor connection pipe 133 is connected to one side of the exhaust pipe 132, and the other longitudinal end of the indoor connection pipe 133 extends adjacent to the ceiling of the garage. In addition, a plurality of inlets 135 are formed in the indoor connection pipe 133 so as to be spaced apart from each other in the longitudinal direction of the indoor connection pipe, so that the exhaust gas floating inside the garage may be efficiently suctioned into the indoor connection pipe 133 through the inlets 135 by suction force of the discharge fan 140, which will be described later.

The dampers 134 are mounted respectively in one side of the discharge pipe 132 and in one side of the indoor connection pipe 133 to adjust the suction force generated by the discharge fan 140, which will be described later. The dampers 134 may adjust the opening rate of the inside of the discharge pipe 132 and the opening rate of the inside of the indoor connection pipe 133 by the discharge fan 140 and may adjust the discharge rate of the exhaust gas from the inside of the discharge pipe 132 and the inside of the indoor connection pipe 133. The operation of the dampers 134 is controlled via the control unit 200, which will be described later.

The discharge fan 140 generates the suction force required to cause the exhaust gas, which is discharged through the exhaust port while the firefighting vehicle 1 is driven inside the garage, to be introduced into the suction hood 120 and the indoor connection pipe 133 of the discharge pipe unit 130, and thereafter, be discharged to the outside of the garage through the discharge pipe 132 of the discharge pipe unit 130. The discharge fan 140 is connected to one side of the discharge pipe unit 130. More specifically, the discharge fan 140 may be connected to the other longitudinal end of the discharge pipe unit 130 so as to be disposed outside the garage.

The elevating drive device 150 is a drive device that generates drive force required to slide the elevating frame 110 in the vertical direction. That is, the elevating drive device 150 is coupled to the base frame 100 and is connected to the elevating frame 110 to transmit the generated drive force to the elevating frame 110 and push or pull the elevating frame 110 upward or downward so that the elevating frame slides in the vertical direction on the elevating guides 100*a* of the base frame 100.

Here, the elevating drive device 150 is illustrated as being formed using a cylinder that operates hydraulically or pneumatically or using electricity, but, needless to say, is not limited thereto, and may realize vertical movement of the elevating frame 110 using a rack gear, a pinion gear, and a motor. In this case, explaining the case in which a cylinder is applied to the elevating drive device 150 in detail, a cylinder body 151 is fixedly coupled to the base frame 100 so that a cylinder rod 152 is vertically disposed therethrough, and the cylinder rod 152 is fixedly connected to each elevating plate 111 of the elevating frame 110. Thus, the elevating plate 111 of the elevating frame 110 is moved in the vertical direction according to the operation of the cylinder, i.e., movement of the cylinder rod 152.

The rotational connection member 160 is a member that interconnects the base frame 100 and the suction hood 120 to cause the suction hood 120 to rotate when the elevating plate 111 of the elevating frame 110 is pushed upward by the drive force generated in the elevating drive device 150. That is, when the elevating plate 111 of the elevating frame 110 is moved upward by the driving of the elevating drive device 150, the rotational connection member 160 causes the suction hood 120 to rotate about the hinge 114 of the elevating frame 110 so that one side of the suction hood 120, in which the suction hole 121 is formed, protrudes upward from the floor of the garage and is disposed adjacent to the exhaust port of the firefighting vehicle 1. One longitudinal end of the rotational connection member 160 is connected to the fixing loop 105 of the base frame 100 and the other longitudinal end of the rotational connection member 160 is connected to the connection loop 123 on the other side of the suction hood 120.

Here, the rotational connection member 160 may be formed using a flexible wire member, but is not limited thereto. For example, the rotational connection member 160 may be formed using an elastic wire member that elastically supports the other side of the suction hood 120 at the initial position at which the elevating frame 110 is not moved upward by the elevating drive device 150, i.e. in the state in which the upper surface of the suction hood 120 is horizontally disposed at a position corresponding to the floor of the garage and then is increased in length by elastic force when the elevating frame 110 is moved upward by the elevating drive device 150. Here, the rotational connection member 160 may be formed using a coil spring that is a concrete example of the elastic wire member.

The vehicle stopper 170 is a member by which the wheel of the firefighting vehicle 1 is caught and stopped. The vehicle stopper 170 is fixedly coupled to the floor of the garage, and in the state in which the firefighting vehicle 1 is stopped such that the exhaust port thereof is disposed adjacent to the upper front side of the suction hood 120, the wheel, more specifically, the rear wheel of the firefighting vehicle 1 is caught by the vehicle stopper 170. Thereby, the vehicle stopper prevents the firefighting vehicle 1 from moving backward and ensures that the exhaust gas discharged from the firefighting vehicle 1 is stably suctioned via the suction hood 120. Here, the vehicle stopper 170 is a bar-shaped member and is formed in the front surface thereof with an engaging groove 171 for engagement of the wheel of the firefighting vehicle 1.

The stoppage detection sensor 180 is a sensor that detects whether or not the firefighting vehicle 1 is caught and stopped by the vehicle stopper 170. That is, the stoppage detection sensor 180 is provided on one side of the vehicle stopper 170, and when the wheel of the firefighting vehicle 1 is caught and stopped by the vehicle stopper in the state of being inserted into the engaging groove 171 in the vehicle stopper 170, the stoppage detection sensor 180 detects this state, and then transmits a detected signal to the control unit 200, which will be described later.

The vehicle detection sensor 190 is a sensor that detects whether or not the firefighting vehicle 1 enters the direction in which the vehicle stopper 170 is provided. That is, the vehicle detection sensor 190 is inserted into the guide groove 10 to detect whether or not the firefighting vehicle 1 moves above the guide groove 10, and then transmit a detected signal to the control unit 200.

The control unit 200 controls the operation of the discharge fan 140 and the elevating drive device 150. That is, the control unit 200 is electrically connected to the discharge fan 140, the elevating drive device 150, the stoppage detection sensor 180, and the vehicle detection sensor 190. In addition, the control unit 200 may be electrically connected to the dampers 134 provided in the discharge pipe unit 130 described above to control the operation of the dampers 134.

The control unit 200 may control the operation of the discharge fan 140 and the elevating drive device 150 in response to the detected signals from the stoppage detection sensor 180 and the vehicle detection sensor 190, or may allow the user to manually control the operation of the discharge fan 140 and the elevating drive device 150, regardless of whether or not signals are input from the stoppage detection sensor 180 and the vehicle detection sensor 190. Here, the control unit 200 includes a manual operation control mode in which the operation of the discharge fan 140 and the elevating drive device 150 is manually controlled by the user and an automatic operation control mode in which the operation of the discharge fan 140 or the elevating drive device 150 is controlled according to whether or not signals are input from the stoppage detection sensor 180 and the vehicle detection sensor 190. Here, the automatic operation control mode may include a shift-work operation mode in which the exhaust gas generated in the firefighting vehicle 1 at the time of exchanging the work of firemen is discharged and an exhaust operation mode in which the exhaust gas inside the garage is automatically discharged at normal times.

An exhaust-gas discharge operation by the fire-engine exhaust-gas discharge device of the embodiment having the above-described configuration will be described with reference to FIGS. 1 to 4.

First, as described above, when the manual operation control mode is set in the control unit 200, the operation of the discharge fan 140 and the elevating drive device 150 is manually controlled by the user, regardless of whether or not signals are input from the stoppage detection sensor 180 and the vehicle detection sensor 190. In the manual operation control mode, the user may manually operate the discharge fan 140 and the elevating drive device 150 to enable the inspection or servicing of the fire-engine exhaust-gas discharge device.

In addition, in the case in which the shift-work operation mode of the automatic operation control mode is set in the control unit 200, when the firefighting vehicle 1 moves backward toward the vehicle stopper 170 so as to be parked in the garage at the time of shift-work, the movement of the firefighting vehicle 1 is detected by the vehicle detection sensor 190, and the discharge fan 140 is operated in response to a detected signal from the vehicle detection sensor to suction and discharge the exhaust gas floating inside the garage through the indoor connection pipe 133 of the discharge pipe unit 130.

Thereafter, when the wheel of the firefighting vehicle 1 is caught and stopped by the vehicle stopper 170, after this state is detected by the stoppage detection sensor 180, the control unit 200 drives the elevating drive device 150 to move the elevating frame 110 upward upon receiving the detected signal. Thereby, the suction hood 120 rotates upward according to the upward movement of the elevating frame 110. At this time, by the rotational connection member 160, one side of the suction hood 120 rotates upward and the other side of the suction hood 120 rotates downward.

Once the elevating frame 110 has been fully moved upward by the elevating drive device 150, the suction hole 121 in the suction hood 120 is obliquely disposed parallel to the direction in which the exhaust gas from the exhaust port of the firefighting vehicle 1 is discharged. Thereby, the exhaust gas, which is discharged from the exhaust port in the state in which the firefighting vehicle 1 is started at the time of shift-work, is stably introduced into and stored in the suction hood 120, and moreover, the exhaust gas introduced into the suction hood 120 is sequentially conveyed to the connection pipe 131 and the discharge pipe 132 of the discharge pipe unit 130 by the suction force of the discharge fan 140, and then is discharged to the outside of the fire station. Thereafter, even after the shift-work for the firefighting vehicle 1 is completed, the control unit 200 performs control to continuously operate the discharge fan 140 and the elevating drive device 150 until the user stops the operation of the discharge fan 140 and the elevating drive device 150.

Finally, in the case in which the exhaust operation mode of the automatic operation control mode is set in the control unit 200, that is, at normal times, the exhaust gas, which is generated when the firefighting vehicle 1 is driven after the completion of the above-described shift-work operation mode or when the firefighting vehicle 1 returns after completion of firefighting activities and is parked in the garage, is suctioned and discharged. That is, when the firefighting vehicle 1, caught and stopped by the vehicle stopper 170, is driven, the movement of the firefighting vehicle 1 is detected by the vehicle detection sensor 190, and the control unit 200 operates the discharge fan 140 and the dampers 134 of the discharge pipe unit 130 to open the indoor connection pipe 133 of the discharge pipe unit 130, thereby causing the exhaust gas inside the garage to be discharged through the indoor connection pipe 133. At this time, the discharge fan 140 is operated for about 2 to 3 minutes, and then the operation is stopped.

Thereafter, when the firefighting vehicle 1 returns to the garage and is parked after completion of firefighting activities, the firefighting vehicle 1 is detected by the vehicle detection sensor 190, and the control unit 200 operates the discharge fan 140 and the dampers 134 of the discharge pipe unit 130 to open the indoor connection pipe 133 of the discharge pipe unit 130, thereby causing the exhaust gas inside the garage to be discharged through the indoor connection pipe 133. In addition, when the wheel of the firefighting vehicle 1 is caught by the vehicle stopper 170, the stoppage detection sensor 180 recognizes that the firefighting vehicle 1 is in the parked state, and the control unit drives the elevating drive device 150 to move the elevating frame 110 upward. Thereby, as described above, the exhaust gas discharged from the exhaust port of the firefighting vehicle 1 is safely discharged to the outside of the garage through the suction hood 120. At this time, the discharge fan 140 is operated for about 2 to 3 minutes, and then the operation is stopped.

As described above, in the fire-engine exhaust-gas discharge device in the fire station, when the elevating frame 110 is moved upward by the elevating drive device 150 in the state in which the base frame 100 is provided in the guide groove 10 formed in the floor of the garage of the fire station and the suction hood 120 is rotatably connected to the elevating frame 110 by the hinge, one side of the suction hood 120 rotates so as to be adjacent to the exhaust port of the firefighting vehicle 1 since the other side of the suction hood 120 is connected to the base frame 100 via the rotational connection member 160, whereby the fire-engine exhaust-gas discharge device enables the exhaust gas discharged from the exhaust port of the firefighting vehicle 1 to be discharged stably to the outside of the garage and does not interfere with the movement or operation of firemen in the garage of the fire station at normal times.

While the present invention has been described with reference to exemplary embodiment illustrated in the accompanying drawings, the above description is merely given by way of example, and it will be understood by those skilled in the art that various modifications and other equivalent embodiments are possible from the above description. Thus, the true scope of the present invention should be determined by the technical idea of the appended claims.

The invention claimed is:

1. A fire-engine exhaust-gas discharge device in a fire station comprising:

a base frame inserted into a guide groove formed in a floor of a garage of the fire station;

an elevating frame connected to an upper portion of the base frame so as to be slidable in a vertical direction;

a suction hood rotatably connected to an upper end of the elevating frame by a hinge and having a cylindrical shape to define a space therein, the suction hood being formed with a suction hole in one side thereof;

a discharge pipe unit having one longitudinal end coupled to the suction hood to communicate with the suction hood and a remaining longitudinal end disposed outside the garage, the discharge pipe unit being configured to guide exhaust gas of the firefighting vehicle in the garage so as to be discharged to an outside of the garage;

a discharge fan connected to the discharge pipe unit to generate suction force that causes the exhaust gas to be discharged to the outside of the garage through the discharge pipe unit;

an elevating drive device provided on the base frame and connected to the elevating frame to generate drive force that slides the elevating frame in the vertical direction;

a rotational connection member having one longitudinal end connected to the base frame and a remaining longitudinal end connected to a remaining side of the suction hood, the rotational connection member being configured to cause the suction hood to rotate about the hinge when the elevating frame is moved upward by the elevating drive device so that the suction hole in the suction hood faces an exhaust port of the firefighting vehicle;

a vehicle stopper coupled to the floor of the garage and configured to cause a wheel of the firefighting vehicle to be caught by the vehicle stopper in a state in which the firefighting vehicle is stopped such that the exhaust port thereof is disposed adjacent to an upper front side of the suction hood;

a stoppage detection sensor provided on the vehicle stopper to detect whether or not the firefighting vehicle is stopped by the vehicle stopper;

a vehicle detection sensor inserted into the guide groove to detect whether or not the firefighting vehicle enters a direction in which the vehicle stopper is provided; and a control unit electrically connected to the discharge fan, the elevating drive device, the stoppage detection sensor, and the vehicle detection sensor and configured to control an operation of the discharge fan and the elevating drive device in response to a signal from the stoppage detection sensor and the vehicle detection sensor or to allow a user to control the operation of the discharge fan and the elevating drive device regardless of the signal from the stoppage detection sensor and the vehicle detection sensor.

2. The device according to claim 1, further comprising a filter plate having a net structure and coupled to the one side of the suction hood to prevent a foreign substance other than the exhaust gas from being introduced through the suction hole.

3. The device according to claim 1, wherein the discharge pipe unit comprises:

a connection pipe having one longitudinal end coupled to the space in the suction hood so as to communicate with the space, the connection pipe having a flexible structure so as to be changeable in length;

a discharge pipe having one longitudinal end connected to a remaining longitudinal end of the connection pipe and a remaining longitudinal end extending to the outside of the garage to guide the exhaust gas, introduced from the suction hood into the connection pipe, so as to be discharged to the outside of the garage; and an indoor connection pipe having one longitudinal end connected to one side of the discharge pipe and a remaining longitudinal end extending adjacent to a ceiling of the garage to guide the exhaust gas floating in the garage so as to be conveyed to the discharge pipe.

4. The device according to claim 1, wherein the elevating drive device is a cylinder that is coupled to the base frame so as to be vertically disposed and has a rod end connected to the elevating frame.

5. The device according to claim 1, wherein the rotational connection member is a wire member.

6. The device according to claim 1, wherein the rotational connection member is a coil spring.

* * * * *